US006083673A

United States Patent [19]

Roussilhe et al.

[11] Patent Number: 6,083,673

[45] Date of Patent: Jul. 4, 2000

[54] ORGANIC/INORGANIC DEVELOPER COMPOSITION

[75] Inventors: Jacques Roussilhe, Virey le Grand, France; Siu Chung Tsoi, Watford, United Kingdom

[73] Assignee: Eastman Kodak Company, Rochester, N.Y.

[21] Appl. No.: 09/052,612

[22] Filed: Mar. 31, 1998

Related U.S. Application Data

[63] Continuation of application No. 08/786,996, Jan. 23, 1997, abandoned.

[30] Foreign Application Priority Data

Jan. 23, 1996 [FR] France ..... 96 01014

[51] Int. Cl.[7] ..... G03C 5/30

[52] U.S. Cl. ..... 430/477; 430/435; 430/400; 430/446; 430/479; 430/480; 430/483

[58] Field of Search ..... 430/477, 479, 430/480, 483

[56] References Cited

U.S. PATENT DOCUMENTS

| | | | |
|---|---|---|---|
| 3,865,591 | 2/1975 | Katz | 430/480 |
| 3,887,375 | 6/1975 | Newman et al. | 430/483 |
| 3,938,997 | 2/1976 | Fisch et al. | 430/468 |
| 3,942,985 | 3/1976 | Newman et al. | 430/484 |
| 3,982,945 | 9/1976 | Willems | 430/479 |
| 5,041,363 | 8/1991 | Sakuma | 430/481 |
| 5,098,819 | 3/1992 | Knapp | 430/480 |
| 5,187,050 | 2/1993 | Yamada et al. | 430/466 |
| 5,236,816 | 8/1993 | Purol et al. | 430/492 |
| 5,238,791 | 8/1993 | Tappe et al. | 430/393 |
| 5,310,631 | 5/1994 | Nakamura et al. | 430/479 |
| 5,474,879 | 12/1995 | Fitterman et al. | 430/483 |

FOREIGN PATENT DOCUMENTS

| | | | |
|---|---|---|---|
| 0 461 783 A1 | 12/1991 | European Pat. Off. . | |
| 2241810 | of 0000 | France . | |
| 265715 | 9/1970 | U.S.S.R. . | |
| 1 025 575 | of 0000 | United Kingdom . | |
| 757271 | 9/1956 | United Kingdom | 430/480 |
| 761300 | 11/1956 | United Kingdom | 430/440 |
| 761301 | 11/1956 | United Kingdom | 430/440 |
| 542502 | 1/1992 | United Kingdom | 430/440 |

OTHER PUBLICATIONS

UDC 77.023.415.22 . . . "The superadditive and activating action of 1–(p–carboxy–ethylpenyl)–pyrazolidone–3" by VL Abritalin et al from ALL–union State Scientific and Design Institute of the Chemical–Photographic Industry, Sep. 1972.

*Primary Examiner*—Hoa Van Le
*Attorney, Agent, or Firm*—J. Lanny Tucker

[57] ABSTRACT

The present invention concerns an organic/inorganic developer composition comprising a regeneratable iron chelate, novel codevelopers of the phenidone type including one or more solubilizing groups that are not directly attached to the phenyl nucleus or to the pyrazolidino nucleus and optionally ascorbic acid. These compositions are particularly useful for the black-and-white development of films or photographic papers, in particular for the fast development of radiographic products.

12 Claims, No Drawings

ORGANIC/INORGANIC DEVELOPER COMPOSITION

This application is a continuation of Ser. No. 08/786,996 filed Jan. 23, 1997 now abandoned.

FIELD OF THE INVENTION

The present invention concerns an organic/inorganic developer composition comprising mainly a regeneratable iron chelate, novel phenidones and optionally ascorbic acid. These compositions are particularly useful for the black-and-white development of films or photographic papers.

BACKGROUND OF THE INVENTION

Use is generally made, in black-and-white developing solutions, of an organic developing agent chosen from di- and poly- hydroxybenzenes and reductones. The most commonly used reductones are described in U.S. Pat. No. 2,691,589, in particular ascorbic acid, its steroisomers, diasteroisomers and derivatives of the carbohydrate type.

Metallic ions such as $Fe^{2+}$, $Ti^{3+}$, $V^{2+}$, $Cr^{2+}$ are also capable of reducing silver ions into metallic silver, and developing solutions comprising organo-metallic complexes have been known for a long time. Thus the French patent BF 1,068,805 describes a development process using organo-metallic complexes of iron or titanium and aminopolycarboxylic acids such as ethylenediaminetetraacetic acid. Other developers comprising complexed metals are described in *The Theory of the Photographic Process*, T. H. James, Ch 11, 4th Edition, pages 294–298 and in *Photographic Chemistry and Physics*, Glafkidés, 5th Edition, Chapter VI, pages 121–123.

The developers comprising organo-metallic complexes have advantages since they easily dissolve-in water, are active in an extensive pH range, are not required to be used in a highly alkaline environment and form a completely reversible oxydo-reduction system. They can be regenerated by electrolysis, as described in U.S. Pat. No. 5,310,631, by contact with steel wool, as described in U.S. Pat. No. 3,945,828, or by ultraviolet irradiation as described by Y. Shirai, in *Papers from International Congress of Photographic Science*, 1982, pp 312–314, Photographic Abstracts ed. The possibility of regenerating this type of developer makes it possible to obtain ecological developers by minimizing the volume of effluent, which helps to avoid water pollution. However, they have not been given a favorable reception in photography since they act slowly and give low-contrast images.

Attempts have been made to reduce the development time by combining an organic developing agent with the organo-metallic complex. For example, *Research Disclosure*, Article 15034, Vol 150 of October 1976, describes a developing composition comprising a metal complexed with a polycarboxylic acid and a pyrazolidone or a p-phenylenediamine.

FR 2,241,810 describes the association of an iron chelate, ascorbic acid and a codeveloper, which may be a phenidone. These compositions are alleged to be stable in air, capable of rapid development and have the possibility of being partially regeneratable.

Known phenidones have low solubility in water, which presents drawbacks with regard to the manufacture of the developer and its ease of use.

SUMMARY OF THE INVENTION

The present invention concerns an aqueous composition for the black-and-white development of photographic products comprising novel codevelopers of the phenidone type that dissolve in water easily. The use of these more soluble phenidones makes manufacture and use of the developer easier and makes it possible to formulate more concentrated compositions.

The aqueous composition for the black-and-white development of photographic products according to the invention comprises:

1) at least one regeneratable ferrous iron chelate in which $Fe^{2+}$ is chelated by a completing agent that is a polycarboxylic or aminopolycarboxylic acid or aromatic polyhydroxy compound, in an $Fe^{2+}$/complexing agent molar ratio of between 1 and 5, 2) at least one codeveloper defined by the formula:

(I)

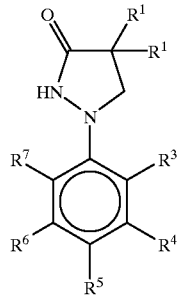

wherein $R^1$ and $R^2$ individually represent hydrogen, an alkyl group, substituted or otherwise, or a group represented by the formula:

$$-(CH_2)_m-(L)_n-A-(Sol)$$

wherein m is from 0 to 5 and n is 0 or 1, L represents $$-O-,\ -S-,\ -NR^8-,\ -\overset{O}{\overset{\|}{C}}O-,\ -\overset{O}{\overset{\|}{C}}O-,\ -\overset{O}{\overset{\|}{O}}CO-,\ -\overset{O}{\overset{\|}{O}}CNR^8-,\ -\overset{O}{\overset{\|}{C}}-,\ -NR^9\overset{O}{\overset{\|}{C}}-,\ -NR^9SO_2-,\ \text{or}\ -NR^9\overset{O}{\overset{\|}{C}}NR^9-,$$

wherein $R^8$ is $R^9$ or A—(Sol), $R^9$ is H, alkyl or aryl, A represents

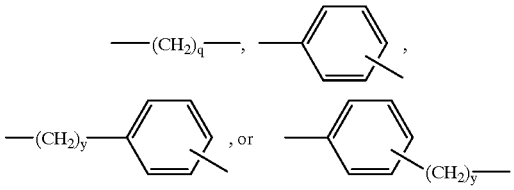

wherein q is between 0 and 5, and y is between 1, and 3, (Sol) is a solubilizing group that is $-CO_2H$, $-SO_3H$, $-NHSO_2R^{10}$, $-SO_2NH_2$, $-SO_2NHR^{10}$, polyhydroxyalkyl,

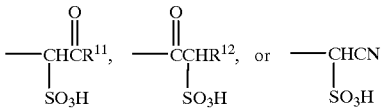

wherein $R^{10}$ is alkyl or aryl, $R^{11}$ is OH, alkyl or aryl, and $R^{12}$ is hydrogen, alkyl or aryl, $R^3$ to $R^7$ each separately represent hydrogen, an alkyl group, an alkoxy group, substituted or otherwise, an aryloxy group, substituted or otherwise, or a group represented by the formula:

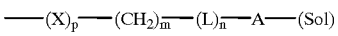

wherein p is 0 or 1,

X represents —O—, —S—, or —$NR^8$—, m, L, n, A, (Sol) and $R^8$ are as defined above, provided that (a) for the $R^3$ to $R^7$ radicals, when m is 0, n must also be 0, (b) in the group A, q can only be equal to 0 if the (Sol) group is

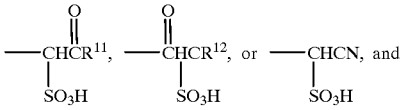

(c) at least one of the $R^1$ to $R^7$ radicals must contain a (Sol) group, and 3) a buffer.

The codevelopers of the phenidone type used in the present invention have a solubility that is improved with respect to known phenidones because of the presence of certain solubilizing groups. Surprisingly, the presence of solubilizing groups such as carboxy or sulfo groups that are not directly attached to the phenyl nucleus or to the pyrazolidino nucleus do not give rise to the large drop in superadditivity observed during the introduction of these solubilizing groups onto the benzene ring in the article in *Zhurnal Nauchnoi I Prikladnoi Fotografii I kinematigrafii* 10 (5), 321–329 (1965) by V. L. Abritalin et al. On the contrary, the developing solutions comprising these compounds as codevelopers have a satisfactory photographic activity.

DETAILED DESCRIPTION OF THIS INVENTION

The developing compositions according to the invention can be used for fast black-and-white development of photographic films and papers. Use is made of fast development systems (also referred to as "short access time" or "rapid access" type) for the development of medical radiographs, graphic arts films and microfilms. These products are developed with highly active solutions for around 30 seconds or less, and the development temperature is approximately 35° C. An example of a developer of the "rapid access" type is the KODAK RP X-OMAT® developer, used for the development of films for medical radiography, which comprises hydroquinone and Phenidone-A® as a codeveloper. Other developers for "rapid access" comprising ascorbic acid and, as the codeveloper, Dimezone-S® are described in *Research Disclosure* of August 1993, Article 35249.

In the present invention, the regeneratable ferrous iron chelate is an iron complex in which the $Fe^{2+}$ ion is chelated with a complexing agent that is an aminopolycarboxylic or polycarboxylic acid and their alkaline salts, or an aromatic polyhydroxy compound.

The complexing agents are preferably nitrilotriacetic acid (NTA), ethylenediamine tetraacetic acid (EDTA), 1,3-diamino-2-propanol-N,N,N',N'-tetraacetic acid, 1,3-diaminopropane-N,N,N',N'-tetraacetic acid, diethylenetriamine pentaacetic acid (DTPA), N,N'-(2-hydroxybenzyl) ethylenediamine-N,N'-diacetic acid (HBED), N-2 (hydroxyethyl) ethylenediamine triacetic acid (HETA), N-methylenediamine triacetic acid (MEDTA), cyclohexane diaminetetraacetic acid, oxalic acid, citric acid, tartric acid, malonic acid, 5-sulfo 8-hydroxyquinoline, pyrocatechol, tetrabromopyrocatechol, gallic acid, methyl gallate, propyl gallate, pyrogallol, 2,3-dihydroxynaphthalene 6-sulfonic acid, 4,5-dihydroxy-m-benzene disulfonic acid, 2,3,8-trihydroxynaphthalene-6-sulfonic acid or salts thereof. A mixture of these complexing agents can be used also.

The $Fe^{2+}$/complexing agent molar ratio is preferably between 1 and 5 and the iron concentration is between 0.05 and 1.0 mol/l and preferably between 0.05 and 0.4 mol/l of the ready-to-use developer composition.

The novel codevelopers of the present invention are 1-phenyl 3-pyrozolidones that have solubilizing groups that are not directly attached to the phenyl nucleus or to the pyrazolidino nucleus. They can be defined by the general formula:

(I)

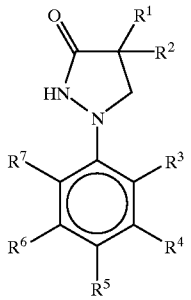

wherein $R^1$ and $R^2$ individually represent hydrogen, an alkyl group, substituted or otherwise, or a group represented by the formula:

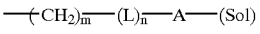

wherein m is from 0 to 5 and n is 0 or 1, L represents

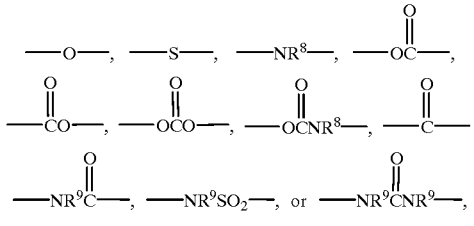

wherein $R^8$ is $R^9$ or A—(Sol), $R^9$ is H, alkyl or aryl,

A represents

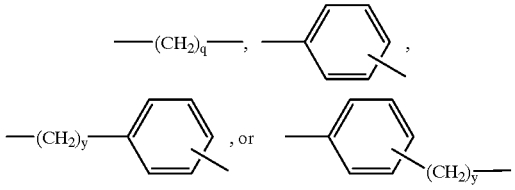

wherein q is between 0 and 5, and y is between 1, and 3, (Sol) is a solubilizing group that is $—CO_2H$, $—SO_3H$, $—NHSO_2R^{10}$, $—SO_2NH_2$, $—SO_2NHR^{10}$, polyhydroxyalkyl,

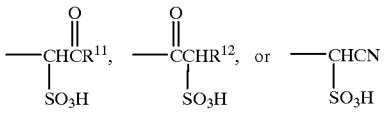

wherein $R^{10}$ is alkyl or aryl, $R^{11}$ is OH, alkyl or aryl, and $R^{12}$ is hydrogen, alkyl or aryl, $R^3$ to $R^7$ each separately represent hydrogen, an alkyl group, an alkoxy group, substituted or otherwise, an aryloxy group, substituted or otherwise, or a group represented by the formula:

wherein p is 0 or 1,

X represents —O—, —S—, or $—NR^8—$, m, L, n, A, (Sol) and $R^8$ are as defined above, provided that (a) for the $R^3$ to $R^7$ radicals, when m is 0, n must also be 0, (b) in the group A, q can only be equal to 0 if the (Sol) group is

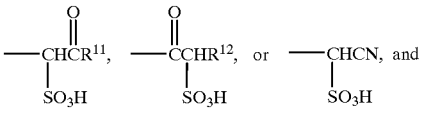

(c) at least one of the $R^1$ to $R^7$ radicals must contain a (Sol) group.

Examples of codevelopers of the phenidone type that can be used in the invention are:

(4-methyl-3-oxo-1-phenylpyrazolidin-4-yl)methyl 2-sulfobenzoate (Compound II)

(II)

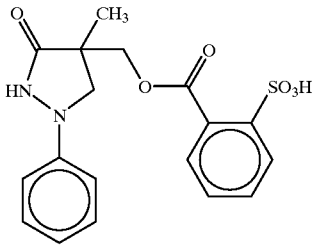

{1-(3,4-dimethylphenyl)-4-methyl-3-oxo-pyrazolidin-4-yl}methyl 2-sulfonobenzoate (Compound III)

(III)

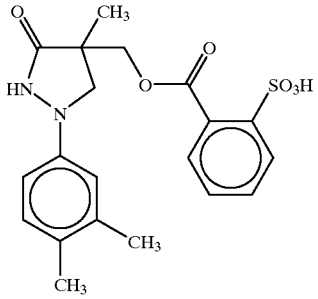

and {1-(3,4-dimethyoxyphenyl)-4-methyl-3-oxo-pyrazolidin-4-yl}methyl 2-sulfobenzoate (Compound IV)

(IV)

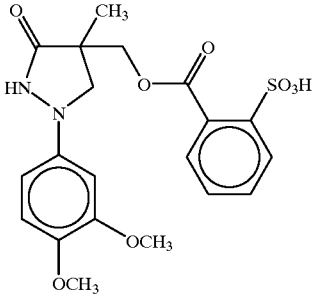

The codeveloper of the phenidone type can be used as the sole codeveloper or else used in a mixture with other codevelopers of the same type or with known aminophenols or phenidones, such as Elon®, Phenidone-A®, Phenidone-B®, Dimezone®, Dimezone-S® or 4,4-bis (hydroxymethyl)-1-phenyl-3-pyrazolidone. In general terms, these codevelopers are described in *Research Disclosure*, publication 36544, September 1994, chapter XIX, page 536.

In practice, a quantity of codeveloper of the phenidone type in the developer composition of between 0.0005 and 0.2 mol/l, and preferably between 0.001 and 0.01 mol/l of ready-to-use solution is used.

The developer compositions of the invention can also include a developing agent of the ascorbic acid type, chosen from ascorbic acid, its derivatives of the sugar type, stereoisomers, diasteroisomers, precursors of these acids and their salts.

For example, use can be made of D-isoascorbic (or erythorbic) acid or L-ascorbic acid and their salts such as sodium or potassium ascorbate or erythorbate; derivatives of ascorbic acid of the carbohydrate type, for example D-glucoascorbic acid, 6-desoxy-L-ascorbic acid, L-rhamnoascorbic acid, L-fucoascorbic acid, D-glucoheptoascorbic acid, sorboascorbic acid, ω-lactoascorbic acid, maltoascorbic acid, L-araboascorbic acid, L-glucoascorbic acid, D-galactoascorbic acid, L-guloascorbic acid, L-alloascorbic acid and imino-L-ascorbic acid; the cetal derivatives of L-ascorbic and D-isoascorbic acid, for example 5,6-isopropylene ascorbic acid; and ascorbic acid precursors, for example methyl-2-cetogluconate or a mixture of the latter substances.

When present, the developer of the ascorbic acid type in the developer composition is present at up to 0.4 mol/l and preferably between 0.15 and 0.30 mol/l.

The buffer is chosen from sodium and potassium carbonates, boric acid, borate salts and alcaholamines, and alkaline agents such as KOH, NaOH, LiOH. Preferably the developer composition of the invention has a pH of between 9 and 11.

An antioxidant of the sulfite type, if present, consists of one or more compounds capable of generating a sulfite or thiosulfate ion in the aqueous solutions. Such compounds comprise sulfites, bisulfites, metabisulfites and bisulfite-aldehyde compounds. The latter constitute both a dialdehyde tanning agent and a sulfite antioxidant. Suitable antioxidants of the sulfite type comprise sodium sulfite, sodium bisulfite, sodium metabisulfite, potassium sulfite, potassium metabisulfite and ammonium metabisulfite. If present, the total quantity of sulfite ions contributed by the sulfite antioxidant is greater than 0.05 mol/l of developer composition.

An organic anti-fogging agent, if present, is a compound or mixture of compounds controlling fogging without reducing the maximum density of the image, or even increasing the maximum density of the products processed. Suitable organic anti-fogging agents are anti-fogging agents of the azole, benzimidazole, benzotriazole and benzothiazole type, as well as heterocyclic mercaptans such as mercaptobenzothiazoles and mercaptotetrazoles. Preferred compounds are 5-nitroindazole, 6-nitroindazole, 1-methyl-5-nitroindazole, 3-methyl-5-nitroindazole, 5-p-nitrobenzoylaminoindazole, 5-nitrobenzimidazole, 2-isopropyl-5-nitrobenzimidazole, benzotriazole, 5-nitrobenzotriazole, 5-methylbenzotriazole, 4-(2-mercapto-1,3,4-thiadiazol-2-yl-thio) butane sodium sulfonate, 5-amino-1,3,4-thiadiazole-2-yl-thiol, 2-mercaptobenzothiazole, 1-phenyl-5-mercaptotetrazole (PMT), 1-(3-acetamidophenyl)-5-mercaptotetrazole and 4-carboxymethyl-4-thiazoline-2-thione. An appropriate range of concentrations for the organic anti-fogging agent is from 0 to 85 mmol/l of ready-to-use developer composition.

The developer compositions of the invention may contain, in addition to the compounds described previously, numerous conventional additives such as those described in *Research Disclosure* of September 1994, Vol 365, Chapter XIX, D and E, for example agents facilitating dissolving or for maintaining the clarity of the solutions, surfactants, agents for sequestering calcium, agents for controlling swelling, or agents for limiting development and controlling fogging, such as sodium or potassium bromide.

The developer compositions of the invention are prepared by dissolving the ingredients in water and adjusting the pH to the desired value. The developer composition can also be concentrated in liquid form and be diluted to form the active solution just before use. It can also be prepared in two or more concentrated parts to be combined and diluted with water in order to obtain the ready-to-use solution and placed in the development tank of an automatic processing machine.

The developer compositions of the invention are useful for developing black-and-white products, such as products for graphic arts, black-and-white films and photographic papers, microfilms, or for the black-and-white development stage for color reversible films and papers. The developer compositions according to the invention are particularly suited to the rapid development of radiographic products.

The invention is illustrated by the following examples:

EXAMPLES 1–3

These examples illustrate the synthesis of the codevelopers.

Synthesis of the compound (4-methyl-3-oxo-1-phenylpyrazolidin-4-yl)methyl 2-sulfobenzoate (Compound II)

To a suspension of 4-methyl-4-hydroxymethyl-1-phenyl-3-pyrazolidinone (Dimezone-S®) (10 g, 48.5 mmol) in neat acetonitrile (200 ml), there is added 2-sulfobenzoic acid cyclic anhydride (8.9 g, 48.5 mmol) all at the same time, at room temperature, while stirring. The reaction mixture is heated to reflux under nitrogen until complete dissolution is observed. The process is continued for 24 hours and the mixture is cooled in a bath of ice and water for 2 hours. A solid precipitant is obtained that is collected by filtration and washed with acetonitrile cooled by means of ice. After drying under vacuum, 17.9 g (95%) of 4-methyl-3-oxo-l-phenyl-pyrazolidin-4-yl)methyl 2-sulfobenzoate (Compound II) is isolated in the form of a whitish solid.

EXAMPLE 2

Synthesis of the compound {1-(3,4-dimethylphenyl)-4-methyl-3-oxo-pyrazolidin-4-yl}methyl 2-sulfobenzoate (Compound III)

To a suspension of {1-(3,4-dimethylphenyl)-4-hydroxymethyl-4-methyl}-3-pyrazolidinone (10.0 g, 42.47 mmol) in neat acetonitrile (200 ml), there is added 2-sulfobenzoic acid cyclic anhydride (7.86 g, 42.74 mmol) all at the same time, at room temperature, while stirring. The reaction mixture is heated to reflux under nitrogen for 24 hours and complete dissolution is observed. After cooling the mixture to room temperature, a copious precipitate forms, which is collected by pump filtration. After washing with acetonitrile and drying under vacuum, 13.7 g (77%) of {1-(3,4-dimethylphenyl)-4-methyl-3-oxo-pyrazolidin-4-yl}methyl 2-sulfobenzoate (Compound III) is isolated in the form of a pale pink solid.

EXAMPLE 3

Synthesis of the compound {1-(3,4-dimethoxyphenyl)-4-methyl-3-oxo-pyrazolidin-4-yl}methyl 2-sulfobenzoate (Compound IV)

To a suspension of {1-(3,4-dimethoxyphenyl)-4-hydroxymethyl-4-methyl}-3-pyrazolidinone (1.0 g, 3.76 mmol) in neat tetrahydrofuran (20 ml), 2-sulfobenzoic acid cyclic anhydride (0.69 g, 3.76 mmol) is added all at the same time, at room temperature, while stirring. The reaction mixture is heated to reflux under nitrogen for 24 hours and complete dissolution is observed. The mixture is cooled in a bath of ice and water; the solid is collected by filtration and washed with acetonitrile. After drying under vacuum, 0.93 g (55%) of {1-(3,4-dimethoxyphenyl)-4-methyl-3-oxo-pyrazolidin-4-yl}methyl 2-sulfobenzoate (Compound IV) is isolated in the form of a pale yellow solid.

In the following examples, the sensitometric results obtained with the developer solutions according to the invention are compared with those of commercial developers.

EXAMPLE 4

In this example a developer solution according to the invention containing $Fe^{2+}$/EDTA, ascorbic acid and, as a codeveloper, Compound II or Compound IV, is compared with a commercially available developer for radiographic products.

A commercially available film A for medical radiography is exposed at 2850 K for 1/50th of a second through a stepped sensitometric wedge with a color correction filter. This film comprises a polyethylene terephthlate support covered on both faces with an emulsion with AgBr tabular grains with a mean diameter of 1.86 μm and a mean thickness of 0.135 μm, chemically sensitized with sulfur, selenium and gold and spectrally sensitized with a green sensitizing dye.

The film is developed for 3 minutes at room temperature without stirring, which is equivalent to a machine processing of 32 seconds at 33.3° C. Fixing for 2 minutes in X-OMAT® fixer and washing for 3 minutes in running water is carried out.

The developer solutions according to the invention (Solutions 1 and 2) and reference solution 1 have the following formulae, in which all concentrations are expressed in mol/l:

| | Reference 1 | Solution 1 (invention) | Solution 2 (invention) |
|---|---|---|---|
| $FeSO_4$ | 0.100 | 0.100 | 0.100 |
| EDTA | 0.225 | 0.225 | 0.225 |
| Ascorbic acid | 0.260 | 0.260 | 0.260 |
| HMMP | 0.005 | | |
| Codeveloper II | | 0.005 | |
| Codeveloper IV | | | 0.005 |
| KBr | 0.08 | 0.08 | 0.08 |
| pH | 10 | 10 | 10 |

HMMP represents 4(hydroxymethyl)-4-methyl-1-phenyl-3-pyrazolidinone or DimezoneS®. This compound is used in developers for commercially available radiographic products.

"LSC" (lower scale contrast) is calculated from the slope of the characteristic curve between a density of 0.85 above the "support plus fogging" density and a density corresponding to −0.3 log E.

"USC" (upper scale contrast) is calculated from the slope of the characteristic curve between a density of 2.85 and a density of 1.50 above the "support plus fogging" density.

The results in Table 1 indicate that the codevelopers II and IV in association with Fe/EDTA and ascorbic acid give results comparable to the commercially available developers for film A.

EXAMPLE 5

In this example, a film B for medical radiography, different from the film A in that the emulsion is pre-tanned, is exposed. This film is processed as in the previous example by developing it with developers whose formula is given below, varying the ascorbic acid content (Asc. ac. in the table). All the concentrations are expressed in mol/l except where otherwise specified.

| | Reference 2 | Solution 2 (invention) | Solution 3 (invention) | Solution 4 (invention) | Reference 3 | Solution 5 (invention) |
|---|---|---|---|---|---|---|
| $FeSO_4$ | 0.100 | 0.100 | 0.100 | 0.100 | 0.200 | 0.200 |
| EDTA | 0.225 | 0.225 | 0.225 | 0.225 | 0.400 | 0.400 |
| Ascorbic acid | 0.260 | 0.260 | 0.200 | 0.140 | 0 | 0 |
| HMMP | 0.005 | | | | 0.005 | |
| Codeveloper II | | 0.005 | 0.005 | 0.005 | | 0.005 |
| PMT | | | | | 70 mg/l | 70 mg/l |
| KBr | 0.08 | 0.08 | 0.08 | 0.08 | 0.008 | 0.008 |
| pH | 10 | 10 | 10 | 10 | 10 | 10 |

The characteristic curves of the density D as a function of the logarithm of the intensity of illumination (Log E) are obtained by means of a densitometer. The sensitometric results are as follows:

TABLE 1

| Developer | Dmin | Dmax | CR | CT | LSC | USC |
|---|---|---|---|---|---|---|
| Reference 1 | 0.23 | 3.24 | 439.5 | 3.07 | 2.19 | 1.94 |
| Solution 1 | 0.22 | 3.36 | 427.6 | 3.07 | 2.18 | 2.05 |
| Solution 2 | 0.23 | 3.35 | 436.5 | 3.20 | 2.21 | 1.98 |

In this table:

$D_{min}$ represents the density of the film resulting from factors other than the radiation used to form the image, $D_{max}$ represents the maximum density for a film which has been exposed and processed, "CR" represents the speed. The speed of the radiographic product is inversely proportional to the exposure required to obtain a given effect. In these examples, it is the value of the exposure that produces a density of 1.00 above the "support plus fogging" density, that is to say above the density of the film plus the density of the layers of emulsion in the unexposed areas.

"CT" represents the contrast. In the examples, the contrast of the film is calculated from the slope of the characteristic curve between a density of 2.00 and a density of 0.25 above the "support plus fogging" density.

PMT represents 1-phenyl-5-mercaptotetrazole. This compound is an anti-fogging agent.

The sensitometric results are as follows:

TABLE 2

| Developer | Dmin | Dmax | CR | CT | LSC | USC |
|---|---|---|---|---|---|---|
| Reference 2 | 0.19 | 3.77 | 437.0 | 3.34 | 2.14 | 3.64 |
| Solution 2 | 0.19 | 3.79 | 426.8 | 2.96 | 2.08 | 2.81 |
| Solution 3 | 0.20 | 3.81 | 426.4 | 2.95 | 2.06 | 2.68 |
| Solution 4 | 0.19 | 3.66 | 424.3 | 3.00 | 2.09 | 2.51 |
| Reference 3 | 0.23 | 3.06 | 430.3 | 1.92 | 1.68 | 0.85 |
| Solution 5 | 0.20 | 3.81 | 428.1 | 3.27 | 2.25 | 2.54 |

The results in Table 2 indicate that the ascorbic acid can be reduced or even eliminated provided that the quantity of iron $Fe^{2+}$ and EDTA are increased and an anti-fogging agent is added. It will also be observed that the codeveloper II in the present invention can be substituted for HMMP without impairing the sensitometric properties.

EXAMPLE 6

In this example, film B is exposed and processed as in Example 5, except those developer solutions comprising HETA (N-2(hydroxyethyl) ethylenediamine triacetic acid) is used in place of EDTA.

The developer solutions according to the invention (solutions 6 and 7) and reference solution 4 have the following formulae in which all concentrations are expressed in mol/l, except where otherwise specified:

| | Reference 4 | Solution 6 (invention) | Solution 7 (invention) |
|---|---|---|---|
| $FeSO_4$ | 0.150 | 0.150 | 0.150 |
| HETA | 0.400 | 0.400 | 0.400 |
| HMMP | 0.005 | | |
| Codeveloper II | | 0.005 | |
| Codeveloper IV | | | 0.005 |
| KBr | 0.08 | 0.08 | 0.08 |
| PMT | 35 mg/l | 35 mg/l | 35 mg/l |
| pH | 10 | 10 | 10 |

The sensitometric results are as follows:

TABLE 3

| Developer | Dmin | Dmax | CR | CT | LSC | USC |
|---|---|---|---|---|---|---|
| Reference 4 | 0.21 | 3.68 | 432.4 | 2.98 | 2.03 | 3.21 |
| Solution 6 | 0.20 | 3.71 | 426.6 | 2.92 | 2.03 | 2.90 |
| Solution 7 | 0.20 | 3.69 | 431.8 | 2.80 | 2.05 | 2.81 |

The results in Table 3 indicate that the codevelopers II and IV in association with $Fe^{2+}$/HETA give acceptable results if they are compared with corresponding developers containing HMMP as a codeveloper.

EXAMPLE 7

In this example, film B is exposed and processed as in Example 5, except that developer solutions comprising DTPA (diethylene triamine pentaacetic acid) are used in place of EDTA.

The developer solutions according to the invention (solutions 8 and 9) and reference solution 5 have the following formulae, in which all concentrations are expressed in mol/l, except where otherwise specified:

| | Reference 5 | Solution 8 (invention) | Solution 9 (invention) |
|---|---|---|---|
| $FeSO_4$ | 0.150 | 0.150 | 0.150 |
| DTPA | 0.300 | 0.300 | 0.300 |
| Ascorbic Acid | 0.260 | 0.260 | 0.260 |
| HMMP | 0.005 | | |
| Codeveloper II | | 0.005 | |
| Codeveloper IV | | | 0.005 |
| KBr | 0.08 | 0.08 | 0.08 |
| PMT | 35 mg/l | 35 mg/l | 35 mg/l |
| pH | 10 | 10 | 10 |

The sensitometric results are as follows:

TABLE 4

| Developer | Dmin | Dmax | CR | CT | LSC | USC |
|---|---|---|---|---|---|---|
| Reference 5 | 0.65 | 3.96 | 437.4 | 2.27 | 1.71 | 2.14 |
| Solution 8 | 0.26 | 4.01 | 433.5 | 2.28 | 1.69 | 2.94 |
| Solution 9 | 0.29 | 4.06 | 436.6 | 2.36 | 1.74 | 3.28 |

The results in Table 4 indicate that the codevelopers II and IV in association with $Fe^{2+}$/DTPA and ascorbic acid give results that are comparable to if not better than the results obtained with the corresponding developers containing HMMP as a codeveloper.

In conclusion, the organic/inorganic black-and-white developers of the invention have an activity comparable to or better than commercially available organic developers, but have better solubilization properties and can be regenerated more easily.

The invention has been described in detail with particular reference to preferred embodiments thereof, but it will be understood that variations and modifications can be effected within the spirit and scope of the invention.

We claim:

1. An aqueous composition for black-and-white development of photographic products comprising:

1) at least one regeneratable ferrous iron chelate in which $Fe^{2+}$ is chelated by a complexing agent that is a polycarboxylic or aminopolycarboxylic acid or aromatic polyhydroxy compound, in an $Fe^{2+}$/complexing agent molar ratio of between 1 and 5, 2) at least one codeveloper defined by the formula:

(I)

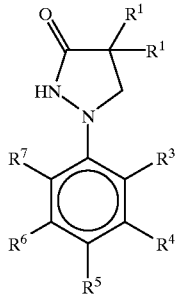

wherein $R^1$ and $R^2$ individually represent, a substituted or unsubstituted alkyl group, or a group represented by the formula:

$$-(CH_2)_m-(L)_n-A-(Sol)$$

wherein m is from 0 to 5 and n is 0 or 1, L represents

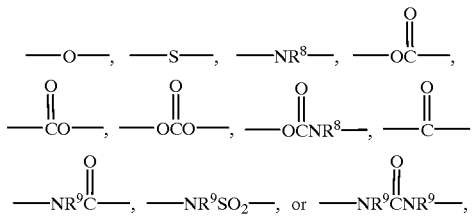

wherein $R^8$ is $R^9$ or A—( Sol), $R^9$ is H, alkyl or aryl, A represents

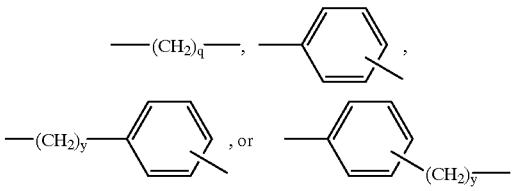

wherein q is between 0 and 5, and y is between 1, and 3, (Sol) is a solubilizing group that is $—CO_2H$, $—SO_3H$, $—NHSO_2R^{10}$, $—SO_2NH_2$, $—SO_2NHR^{10}$, polyhydroxyalkyl,

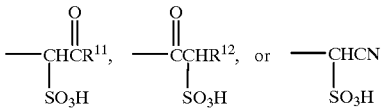

wherein $R^{10}$ is alkyl or aryl, $R^{11}$ is OH, alkyl or aryl, and $R^{12}$ is hydrogen, alkyl or aryl, $R^3$ to $R^7$ each separately represent hydrogen, an alkyl group, a substituted or unsubstituted alkoxy group, a substituted or unsubstituted aryloxy group, or a group represented by the formula:

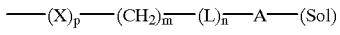

wherein p is 0 or 1,

X represents —O—, —S—, or $—NR^8—$, m, L, n, A, (Sol) and $R^8$ are as defined above, provided that (a) for the $R^3$ to $R^7$ radicals, when m is 0, n must also be 0, (b) in the group A, q can only be equal to 0 if the (Sol) group is

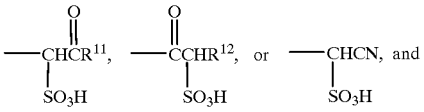

(c) at least one of the $R^1$ to $R^7$ radicals must contain a (Sol) group, and 3) a buffer.

2. The aqueous composition of claim 1 further comprising an ascorbic acid type developer.

3. The aqueous composition of claim 1 further comprising an antioxidant of the sulfite type.

4. An aqueous composition of claim 1 further comprising an organic anti-fogging agent.

5. The aqueous composition of claim 1 wherein said codeveloper is (II)

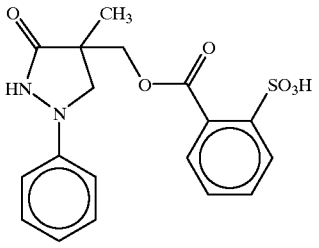

-continued (III)

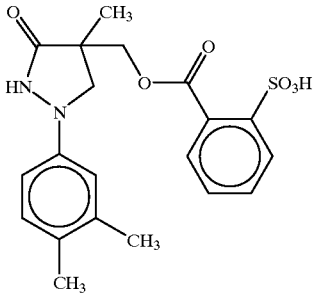

or (IV)

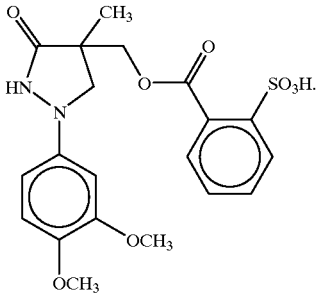

6. The aqueous composition of claim 1 wherein the complexing agent is nitrilotriacetic acid (NTA), ethylenediamine tetraacetic acid (EDTA), 1,3-diamino-2-propanol-N,N,N',N'-tetraacetic acid, 1,3-diaminopropane-N,N,N',N'-tetraacetic acid, diethylenetriamine pentaacetic acid (DTPA), N,N'-(2-hydroxybenzyl) ethylenediamine-N,N'-diacetic acid (HBED), N-2(hydroxyethyl) ethylenediamine triacetic acid (HETA), N-methylenediamine triacetic acid (MEDTA), cyclohexane diaminetetraacetic acid, oxalic acid, citric acid, tartric acid, malonic acid, 5-sulfo 8-hydroxyquinoline, pyrocatechol, tetrabromopyrocatechol, gallic acid, methyl gallate, propyl gallate, pyrogallol, 2,3-dihydroxynaphthalene 6-sulfonic acid, 4,5-dihydroxy-m-benzene disulfonic acid, or 2,3,8-trihydroxynaphthalene-6-sulfonic acid, 4,5-dihydroxy-m-benzene disulfonic acid, or 2,3,8-trihydroxynaphthalene-6-sulfonic acid, or a salt thereof.

7. The aqueous composition of claim 2 wherein the developer of the ascorbic acid type is ascorbic acid, a derivative of ascorbic acid of the sugar type, a stereoisomer, diastereoisomer, precursor of these acids or their salts.

8. The aqueous composition of claim 7 wherein the developer of the ascorbic acid type is L-ascorbic acid or D-isoascorbic acid.

9. The aqueous composition of claim 3 wherein the antioxidant of the sulfite type is a sulfite, bisulfite, metabisulfite or aldehyde-bisulfite compounds, 1) said ferrous iron chelate is a ferrous chelate of ethylenediamine tetraacetic acid (EDTA), diethylenetriamine pentaacetic acid (DTPA) or N-2(hydroxyethyl) ethylenediamine triacetic acid (HETA), in which the $Fe^{2+}$/complexing agent molar ratio is between 1 and 5 and the iron concentration is between 0.05 and 1.0 mol/l, 2) said codeveloper is present at from 0.0005 to 0.2 mol/l, 3) and further comprises ascorbic acid or D-isoascorbic acid in a quantity between 0 and 0.4 mol/l, the quantities being expressed per liter of ready-to-use developer.

10. The aqueous composition of claim 9, comprising:

1) a ferrous chelate of ethylenediamine tetraacetic acid (EDTA) in a quantity such that the iron concentration is between 0.05 and 0.4 mol/l, 2) from 0.001 to 0.01 mol/l of said codeveloper, and 3) from 0.15 to 0.30 mol/l of ascorbic acid, the quantities being expressed per liter of ready-to-use developer.

11. A photographic development process comprising contacting an exposed photographic product with the aqueous composition of claim 1 for less than 1 minute.

12. The process of claim 11 wherein said exposed photographic product is a radiographic product.

* * * * *